US008105340B2

(12) United States Patent
Grieshaber et al.

(10) Patent No.: US 8,105,340 B2
(45) Date of Patent: Jan. 31, 2012

(54) EPILATOR

(75) Inventors: Frieder Grieshaber, Neu-Anspach (DE); Klaus-Peter Lange, Eppstein (DE); Klaus Ramspeck, Langen (DE); Christof Ungemach, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 462 days.

(21) Appl. No.: 10/574,191

(22) PCT Filed: Sep. 3, 2004

(86) PCT No.: PCT/EP2004/009823
§ 371 (c)(1),
(2), (4) Date: Sep. 14, 2006

(87) PCT Pub. No.: WO2005/039348
PCT Pub. Date: May 6, 2005

(65) Prior Publication Data

US 2007/0043383 A1 Feb. 22, 2007

(30) Foreign Application Priority Data

Sep. 29, 2003 (DE) ..... 103 45 592

(51) Int. Cl.
*A61B 17/50* (2006.01)

(52) U.S. Cl. ..... 606/133; 606/131

(58) Field of Classification Search ..... 606/131, 606/132, 133, 134; 128/898
See application file for complete search history.

(56) References Cited

U.S. PATENT DOCUMENTS

| | | | | |
|---|---|---|---|---|
| 2,423,245 | A * | 7/1947 | Magnus et al. | 606/134 |
| 2,480,252 | A | 8/1949 | Magnus | |
| 5,133,722 | A * | 7/1992 | Avrahami et al. | 606/133 |
| 5,507,753 | A | 4/1996 | Iwasaki et al. | |
| 6,183,442 | B1 * | 2/2001 | Athanasiou et al. | 604/154 |
| 7,354,423 | B2 * | 4/2008 | Zelickson et al. | 604/289 |
| 2005/0234477 | A1 * | 10/2005 | Brown et al. | 606/131 |
| 2006/0004383 | A1 * | 1/2006 | Floessholzer et al. | 606/133 |

FOREIGN PATENT DOCUMENTS

| | | |
|---|---|---|
| DE | 299 19 410 | 3/2000 |
| FR | 2 245 314 | 4/1975 |
| JP | 2001-128728 A | 5/2001 |
| WO | WO2004/016127 | 2/2004 |

* cited by examiner

*Primary Examiner* — Tuan Nguyen
(74) *Attorney, Agent, or Firm* — David K Mattheis; Kelly L McDow; Kim Zerby

(57) ABSTRACT

The invention is directed to an epilator apparatus for the removal of hair. The epilator apparatus comprises a tape, which adheres to the hairs as the apparatus is moved relative to the skin. The motion of the apparatus relative to the skin feeds the tape into the plucking zone where the tape with the hairs adhered thereto is redirected perpendicular to the skin. This redirection results in the hairs being plucked from the skin as the epilator apparatus is advanced.

2 Claims, 1 Drawing Sheet

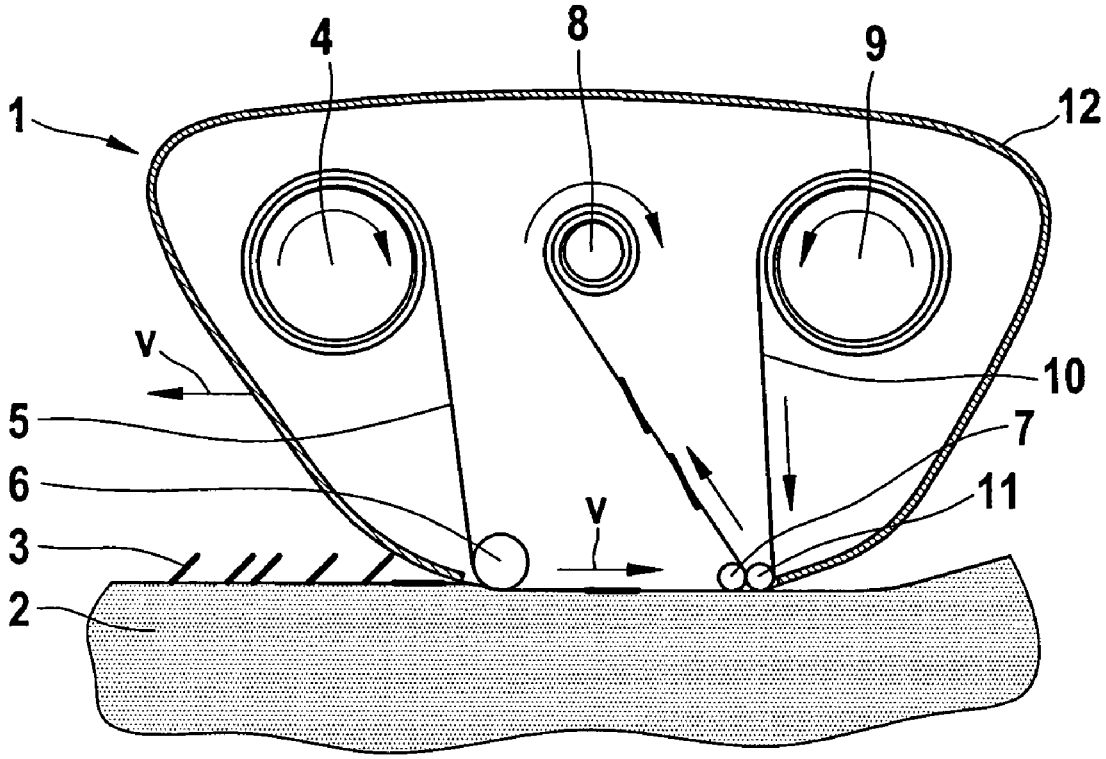
1
2
3
4
5
6
7
8
9
10
11
12
v
v

EPILATOR

This invention relates to an epilator apparatus and method for the removal of hair.

BACKGROUND

A wide variety of epilators are used for extracting hair. For example, European patent EP 0 705 546 A2 discloses an epilator having mechanical clamping devices for clamping and plucking hairs. The clamping devices are arranged on an axle. Each clamping device is comprised of a pair of axially adjacent clamping elements at least one of each pair of elements is drivable in an axial direction so that the clamping elements of each pair can be urged against each other axially. In addition, the clamping elements can be driven to perform an oscillatory rotary motion. As this occurs, the clamping elements of a pair close while oscillating from a first to a second position to trap a hair. Then they maintain their closed position while oscillating back into the first position in order to pluck the hair. Each two movable clamping elements are urged against the one stationary clamping element from both sides to avoid undesired vibrations and an attendant noise development.

Another patent WO 98/05234 describes a rotary cylinder for an epilator apparatus. The rotary cylinder includes a plurality of pairs of clamping elements essentially arranged in an angularly offset relation to each other. The rotary cylinder further includes actuating elements for bringing the clamping elements into clamping contact with one another in pairs in the area of a plucking zone of the epilator, and then separating them again. Moreover, provision is made for at least one control element for controlling the actuating elements. Each pair of clamping elements is assigned a separate, individually movable actuating element.

U.S. Pat. No. 5,041,122 describes a depilation apparatus, which comprises at least one pair of rollers rotating in opposite directions. The roller pair is covered by a shear plate having elongate apertures. The shear plate keeps the skin away from the rollers while enabling the hair to penetrate the apertures in the shear plate to be subsequently caught by the rollers.

The aforementioned epilators with their discretely plucking clamping devices allow a relatively reliable extraction of the hairs captured by them. However, under marginal conditions they do not perform with optimal efficiency in providing a painless extraction with a long lasting effect.

Therefore, an epilator apparatus is needed that enables an efficient, and long-lasting, removal of hairs with minimum discomfort for a user.

SUMMARY

The aforementioned problems are overcome by the present disclosure of an epilator apparatus for the removal of hairs comprising a tape, which has an adhesive effect and is fed to a plucking zone in which the hairs are plucked from the skin.

One advantage of the present invention is that, in principle, all the hairs can be extracted in the area covered by the tape, because the tape grasps the hairs over its entire surface area, leaving no systematic gaps in the capturing of hairs. Thereby removing hairs in the covered area very effectively.

In a preferred embodiment, the epilator apparatus comprises a pressure device for applying the tape against the skin, with the tape being oriented relative to the pressure device, such that the adhesive side is applied against the skin. In this manner, a reliable adherence of the hairs to the tape can be achieved.

In a preferred embodiment, a deflector device is arranged in the plucking zone of the epilator apparatus, which guides the tape away from the skin. Thus, a provision is made for the tape to be fed from the pressure device to the deflector device. The deflector device may include two juxtaposed deflector elements, with the tape being passed between the two deflector elements which are preferably urged against each other. In this embodiment, it is particularly advantageous for the two deflector elements to be rotatably suspended. With this approach, the hairs are extracted from the skin at relatively low speed, and essentially perpendicular to the skin surface, while removing a relatively high amount of root together with the hairs. As a consequence, the period of time between epilation treatments can be extended considerably. This also results in the noise level being relatively low during operation of the epilator apparatus.

In a preferred embodiment of the epilator apparatus, the tape can be unwound from a first supply reel. Furthermore, a take-up reel can be provided for receiving the tape. This has the advantage of enabling the tape to be replaced readily, and of ensuring a consistent quality of epilation, since the tape is used just once. In another embodiment, a drive motor can be provided for driving the take-up reel.

In a preferred embodiment, an additional tape converges with the tape in the plucking zone. This results in binding the extracted hairs and ablated scales between the tape and the additional tape. As a result, soiling of the epilator apparatus can be prevented, providing a hygienic epilating action without involving elaborate cleaning work. In an embodiment, the tape and/or the additional tape can be an adhesive tape. Since adhesive tape is available in an enormous variety and at low cost, providing an adhesive tape with an appropriate adhesion for use in various embodiments of the present invention is not a problem.

In another preferred embodiment, comfortable and reliable operation of the epilator apparatus can be ensured by providing a device for activating the drive motor when the epilator apparatus is applied against the skin.

A method for the removal of hair by means of an epilator apparatus comprises bringing a tape into a contacting relationship with the skin by the epilator apparatus, adhering the hairs to the tape, feeding the tape into a plucking zone of the epilator apparatus, and plucking the hairs from the skin in the plucking zone.

In a preferred embodiment, the method comprises guiding the tape away from the skin in the plucking zone, and thereby lifting the hairs relative to the skin. In this manner, the hairs are reliably grasped for the plucking action. Together with the tape, the lifted hairs can be held clamped between two deflector elements and extracted from the skin. The tape sets the two deflector elements in rotary motion of opposite direction. During epilation, the surrounding skin can be held fixed by the deflector elements. In an embodiment, the method further comprises carrying both the hairs adhered to the tape after plucking, and the tape away together.

The movements necessary for epilation may be generated in a variety of ways. In one embodiment, the feeding movement of the tape can produce a forward movement of the epilator apparatus relative to the skin. In another embodiment, the tape can be driven by manually advancing the epilator apparatus relative to the skin.

The present invention will be explained in more detail in the following description with reference being made to the embodiment illustrated in the accompanying drawing.

BRIEF DESCRIPTION OF THE DRAWINGS

FIG. 1 is a highly schematic sectional view of an embodiment of an epilator apparatus of the present invention.

DETAILED DESCRIPTION

The epilator apparatus 1 is shown during the act of epilating involving the removal of hairs 3 from the skin 2. The epilator apparatus 1 includes an adhesive tape 5 wound on a first supply reel 4 and fed to a take-up reel 8 via a pressure roller 6 and a first guide roller 7. Further provided is a second supply reel 9 holding an additional adhesive tape 10 which is fed to the take-up reel 8 via a second guide roller 11. In addition, the epilator apparatus 1 has a casing 12.

The first supply reel 4, the take-up reel 8 and the second supply reel 9 can be arranged at nearly any position in or on the epilator apparatus 1. In this context, however, attention has to be paid to ensure that the adhesive tape 5 and the additional adhesive tape 10 can be guided in the above-described manner. If necessary, the adhesive tape 5 and/or the additional adhesive tape 10 may be guided through further rollers not shown in the FIGURE.

The pressure roller 6 and the two guide rollers 7 and 11 are arranged on that end of the epilator apparatus 1 that is applied against the skin 2 during epilation. At this end the casing 12 is open toward the skin 2, so that the pressure roller 6 and the two guide rollers 7 and 11 are accessible from outside. The pressure roller 6 urges the adhesive tape 5 against the skin 2, with the adhesive side of the tape 5 resting against the skin 2. Furthermore, the adhesive tape 5 is oriented parallel to the surface of the skin 2 by the pressure roller 6 in cooperation with the first guide roller 7.

The first guide roller 7 and the second guide roller 11 are located in close proximity to one another in a plucking zone in which the hairs 3 are plucked from the skin 2. The adhesive tape 5 and the additional adhesive tape 10 are passed between the two guide rollers 7 and 11, with their adhesive sides being pressed against each other for adhesive bonding. In this condition, the adhesive tape 5 and the additional adhesive tape 10 are wound onto the take-up reel 8 jointly.

The winding-up process can be assisted by a drive motor not shown in the FIGURE, which sets the take-up reel 8 in rotation. The direction of rotation of the take-up reel 8 is shown by an arrow. Equally, the directions of rotation of the supply reels 4 and 9, the directions of feed of the adhesive tape 5 and the additional adhesive tape 10 as well as the direction of movement of the epilator apparatus 1 are also shown by arrows.

With the epilator apparatus 1 of the invention the act of hair removing is performed in the following manner:

As shown in the FIGURE, the epilator apparatus 1 is placed against the skin 2 such that the adhesive sides of the adhesive tape 5 and of the additional adhesive tape 10 are urged into contacting relation to the skin by the pressure roller 6 and the first guide roller 7 and, respectively, the second guide roller 11. As the epilator apparatus 1 is applied against the skin 2, the drive motor of the take-up reel 8 is activated, setting the take-up reel 8 in rotation. The drive motor is activated by a sensor arrangement using, for example, a pressure-operated switch. The rotational velocity of the take-up reel 8 can be predetermined via a control of the drive motor. Rotation of the take-up reel 8 causes the adhesive tape 5 and the additional adhesive tape 10 to be wound onto the take-up reel 8 in adhesive-bonded condition. Correspondingly, the adhesive tape 5 and the additional adhesive tape 10 are unwound from their supply reels 4 and 9. The adhesive tape 5 fed from the first supply reel 4 to the take-up reel 8 is applied against the skin 2 by the pressure roller 6. As a result of the adhesive effect produced by the adhesive tape 5 on the skin 2 and the hairs 3, the epilator apparatus 1 is moved parallel to the surface of the skin 2 at a velocity v amounting to the feed rate of the adhesive tape 5. In the representation shown in the FIGURE, the epilator apparatus 1 moves from right to left. As this movement proceeds, the adhesive side of the adhesive tape 5 continually makes contact with more hairs 3 then adhering to the adhesive tape 5. On passing the first guide roller 7, the hairs 3 adhering to the adhesive tape 5 are lifted due to the deflection of the adhesive tape 5 and are clamped between the adhesive tape 5 and the additional adhesive tape 10 by the two guide rollers 7 and 11 which are pressed against each other. By reason of the clamping action produced by the guide rollers 7 and 11 and the adhesive effect between the adhesive tape 5 and the additional adhesive tape 10, the hairs 3 are entrained with the adhesive tape 5 and the additional adhesive tape 10 and plucked out in the process, that is, the skin 2 is epilated.

In the use of guide rollers 7 and 11 of equal size, epilation takes place at an angle of 90° relative to the surface of the skin 2. The velocity at which the hairs 3 are plucked from the skin 2 equals the velocity v of the epilator apparatus 1 or the adhesive tape 5 and is relatively low. The relatively low plucking speed and the vertical orientation of the plucking motion relative to the skin surface have the effect of a relatively high root portion being removed together with the hairs 3. During the process of epilation, the two guide rollers 7 and 11 largely prevent the skin 2 in the immediate vicinity of the hair 3 just extracted from yielding to the pulling tension applied to the skin 2 by this particular hair 3, so that the pain caused by epilation can be kept at a relatively low level. The extracted hairs 3 as well as ablated scales are trapped between the adhesive tape 5 and the additional adhesive tape 10 and carried away to prevent soiling of the epilator apparatus 1. When the adhesive tape 5 and the additional adhesive tape 10 are completely unwound from the supply reels 4 and 9, the supply reels 4 and 9 are replaced. This also includes replacement of the take-up reel 8 holding the adhesive tape 5 adhesive-bonded to the additional adhesive tape 10.

In the above-described embodiment of the epilator apparatus 1 the advancing motion of the epilator apparatus 1 relative to the skin 2 is produced by means of the drive motor for the take-up reel 8. To perform epilation, the user merely applies the epilator apparatus 1 against the skin 2, guiding it manually to determine the direction of the forward movement. Alternatively, the possibility also exists for the epilator apparatus 1 to dispense with a drive motor for the take-up reel 8. In this event, the forward movement of the epilator apparatus 1 is produced manually, thereby driving the tape 5.

In another embodiment, epilator apparatus 1 is modified, such that a masking tape having no adhesive coating is substituted for the additional adhesive tape 10. Moreover, it is also possible to dispense with the additional adhesive tape 10 and hence the second supply reel 9 entirely. In this embodiment, the second guide roller 11 can be maintained to enable the hairs 3 to be clamped between the adhesive tape 5 and the second guide roller 11.

Another embodiment includes replacing the adhesive tape 5 with a tape which is not coated with an adhesive, producing adherence of the hairs 3 in some other way. Adherence of the hairs 3 could be also accomplished, for example, by providing the tape with a suitable surface structure or charging it electrostatically.

The adhesive tape 5 and, if applicable, the additional adhesive tape 10 inclusive of the required supply and take-up reels, pressure and guide rollers can be constructed as an assembly or cartridge replaceable as a complete unit. This embodiment enables a simple and particularly hygienic disposal of the adhesive tape and the adhering hairs.

In other embodiments of the epilator apparatus 1, devices are provided to influence the orientation of the hairs 3 adhering to the adhesive tape 5. Such devices attempt to align the hairs 3 in the direction of movement of the adhesive tape 5 in order to facilitate lifting of the hairs 3 from the skin 2 in the plucking zone. In one embodiment for allowing for the alignment of the hairs 3, a comb arranged to precede the pressure roller 6 can be provided. In lieu of the comb, a cylinder can also be used. In a preferred embodiment, an actively driven comb or a brush, such as a cylindrical brush, which combs the hairs toward the adhesive tape 5 and aligns the hair ends in this direction can be used. Moreover, the alignment of the hairs 3 can also be influenced by an electrostatic charge. Additionally, by suitably selecting the direction of forward movement of the epilator apparatus 1 relative to the orientation of the hairs 3 on the skin 2, the user is also offered the possibility of acting on the alignment of the hairs 3 on the adhesive tape 5.

The invention claimed is:

1. An epilator apparatus for the removal of hairs comprising:

a tape configured to adhere to hairs before being fed to a plucking zone where the adhered hairs are plucked from skin;

a take-up reel configured to receive the tape downstream of the plucking zone;

a drive motor configured to drive the take-up reel; and a switch in electrical communication with the drive motor and responsive to the application of the epilator apparatus against skin, such that pressure of the epilator apparatus against the skin activates the switch to activate the drive motor, thereby to drive the take-up reel producing forward movement of the apparatus over the skin;

a pressure roller for applying the tape against the skin;

a deflector positioned in the plucking zone such that the deflector guides the tape away from the skin;

wherein the deflector includes two juxtaposed deflector elements arranged such that the tape is passed between the two deflector elements; and wherein the two deflector elements are rotatably suspended.

2. A method of removing hair by means of an epilator apparatus, the method comprising:

placing a tape in contact with skin by application of the epilator apparatus to skin;

adhering hairs to the placed tape;

activating a drive motor, which drives a take-up reel, in response to application of the epilator apparatus against the skin;

feeding the placed tape into a plucking zone of the epilator apparatus;

plucking the adhered hairs from the skin in the plucking zone; and receiving the tape and plucked hairs on the take-up reel downstream of the plucking zone thereby moving the apparatus forward over the skin;

guiding the tape away from the skin in the plucking zone; and lifting the hairs relative to the skin;

clamping the tape and the lifted hairs together between two deflector elements; and extracting the lifted hairs from the skin; and rotating the two deflector elements in opposite directions in response to the motion of the tape.

* * * * *